US012225975B2

(12) United States Patent
Kilgore

(10) Patent No.: US 12,225,975 B2
(45) Date of Patent: Feb. 18, 2025

(54) ARTICLE OF FOOTWEAR WITH HEEL STRUCTURE

(71) Applicant: NIKE, Inc., Beaverton, OR (US)

(72) Inventor: Matthew Kilgore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 77 days.

(21) Appl. No.: 18/163,808

(22) Filed: Feb. 2, 2023

(65) Prior Publication Data

US 2023/0248113 A1 Aug. 10, 2023

Related U.S. Application Data

(60) Provisional application No. 63/306,908, filed on Feb. 4, 2022.

(51) Int. Cl.
*A43B 21/42* (2006.01)

(52) U.S. Cl.
CPC ..... *A43B 21/42* (2013.01)

(58) Field of Classification Search
CPC ..... A43B 21/42; A43B 21/433; A43B 21/44; A43B 21/38; A43B 3/248; A43B 13/00
USPC ..... 36/92
See application file for complete search history.

(56) References Cited

U.S. PATENT DOCUMENTS

| | | | | |
|---|---|---|---|---|
| 4,776,111 | A * | 10/1988 | Crowley | A43B 7/142 36/114 |
| 7,954,257 | B2 | 6/2011 | Banik | |
| 8,677,656 | B2 | 3/2014 | Nishiwaki et al. | |
| D853,707 | S | 7/2019 | Flanagan et al. | |
| 2011/0185592 | A1* | 8/2011 | Nishiwaki | A43B 23/17 36/69 |
| 2018/0110292 | A1* | 4/2018 | Beers | A43B 13/28 |
| 2023/0107425 | A1* | 4/2023 | Andreasen | A43B 11/00 36/138 |

FOREIGN PATENT DOCUMENTS

| | | | |
|---|---|---|---|
| EP | 3649881 | A1 | 5/2020 |
| WO | WO-2020140006 | A1 | 7/2020 |

OTHER PUBLICATIONS

European Patent Office (ISA), International Search Report and Written Opinion for PCT Application No. PCT/US2023/061902, mailed May 22, 2023.

* cited by examiner

*Primary Examiner* — Timothy K Trieu
(74) *Attorney, Agent, or Firm* — Honigman LLP; Matthew H. Szalach; Jonathan P. O'Brien

(57) ABSTRACT

An article of footwear includes an upper, a sole structure attached to the upper and defining a ground-contacting surface, a first receiver disposed on one of a medial side of the upper and a lateral side of the upper and extending over a junction between the upper and the sole structure, and a clip attached to the first receiver and extending around a heel region of the upper.

18 Claims, 9 Drawing Sheets

ARTICLE OF FOOTWEAR WITH HEEL STRUCTURE

CROSS-REFERENCE TO RELATED APPLICATIONS

This application claims priority under 35 U.S.C. § 119(e) to U.S. Provisional Patent Application Ser. No. 63/306,908, filed on Feb. 4, 2022. The disclosure of this prior application is considered part of the disclosure of this application and is hereby incorporated by reference in its entirety.

FIELD

The present disclosure relates generally to an article of footwear.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. Further, the upper may include an ankle opening extending around a heel region of the upper that serves to receive and support a foot within the upper. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. Sole structures may also include a comfort-enhancing insole or a sockliner located within a void proximate to the bottom portion of the upper and a strobel attached to the upper and disposed between the midsole and the insole or sockliner.

While conventional articles of footwear include an upper that positions and supports a foot on a sole structure, such uppers do not include external support structures that can facilitate entry and removal of a foot to and from the upper. Further conventional uppers fail to provide an external structure that can be modified to provide the upper and, thus, the article of footwear with a different appearance and/or performance characteristic.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
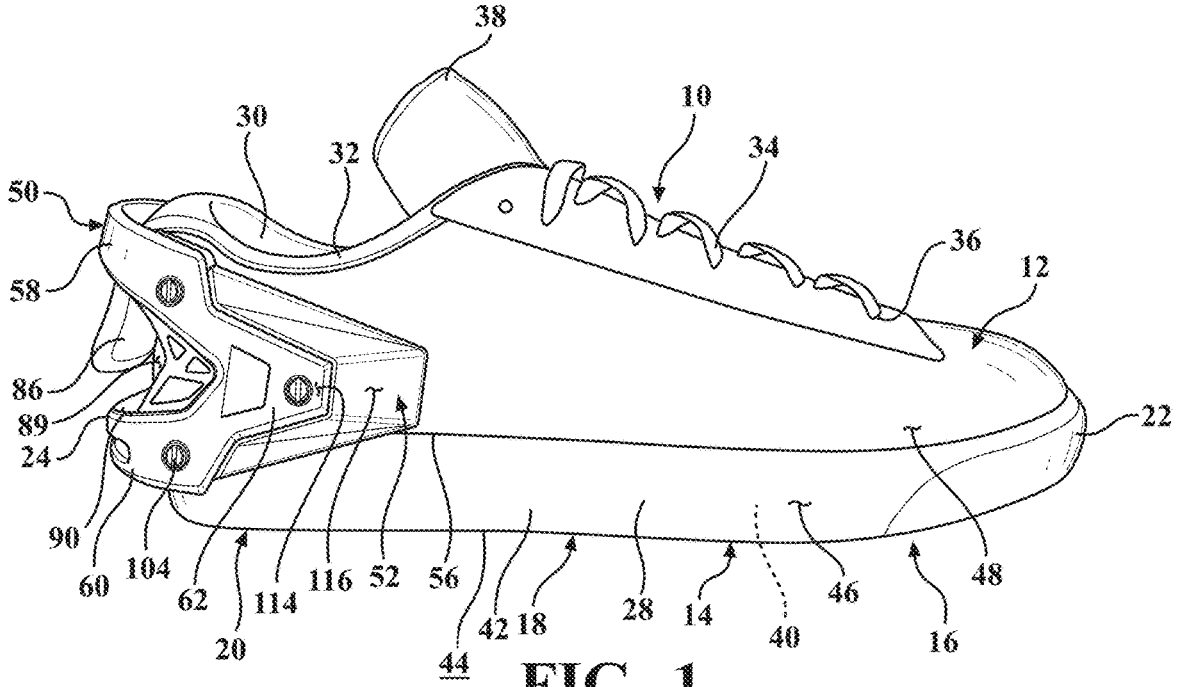
FIG. 1 is a lateral side view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one aspect, an article of footwear includes an upper, a sole structure attached to the upper and defining a ground-contacting surface, a first receiver disposed on one of a medial side of the upper and a lateral side of the upper and extending over a junction between the upper and the sole structure, and a clip attached to the first receiver and extending around a heel region of the upper.

The article of footwear may include one or more of the following optional features. For example, the first receiver may include a first recess. The clip may include a first brace disposed adjacent to an ankle opening of the upper and a second brace spaced apart from the first brace and disposed adjacent to the sole structure, the first brace and the second brace may joined to one another at a first junction that is received by the first recess of the first receiver. The recess may include a shape that conforms to a shape of the first junction. A second receiver may be disposed on the other of the medial side and the lateral side and may extend over the junction between the upper and the sole structure, the second receiver including a second recess that receives a second junction where the first brace and the second brace are joined to one another.

In one configuration, the clip may be attached to the first receiver by at least one threaded fastener. In this configuration, the first receiver may include at least one threaded bore that receives the threaded fastener.

The clip may include an aperture proximate to an ankle opening of the upper. A tab may be attached to the ankle opening and may be received through the aperture of the clip. The tab may include a fastener that mates with a fastener attached to an outer surface of the upper.

In another configuration, an article of footwear may include an upper, a sole structure attached to the upper and defining a ground-contacting surface, a first receiver disposed on one of a medial side of the upper and a lateral side of the upper, a second receiver disposed on the other of the medial side of the upper and the lateral side of the upper, and a clip attached to the first receiver and the second receiver and including a first brace extending proximate to an ankle opening of the upper and a second brace extending proximate to the sole structure, the first brace spaced apart and separated from the second brace and including an aperture through which a portion of the upper extends.

The article of footwear may include one or more of the following optional features. For example, the clip may extend around a heel region of the upper. Additionally or alternatively, the aperture may be an elongate slot that extends along a length of the first brace. The portion of the upper that extends through the elongate slot may be a tab that extends from an ankle opening of the upper. The tab may include a first fastener and the upper may include a second fastener, the first fastener selectively engaging the second fastener between the first brace and the second brace when the tab extends through the elongate slot.

In one configuration, the clip may be attached to the first receiver by a first threaded fastener and may be attached to the second receiver by a second threaded fastener. Additionally or alternatively, the clip may be formed from a material that is more rigid than a material forming the upper. Further, the upper may be exposed between the first brace and the second brace.

At least one reinforcement rib may extend between and connect the first brace and the second brace. At least one of the first brace and the second brace may include a thickness that tapers in a direction toward the first receiver and the second receiver.

Figure 2:
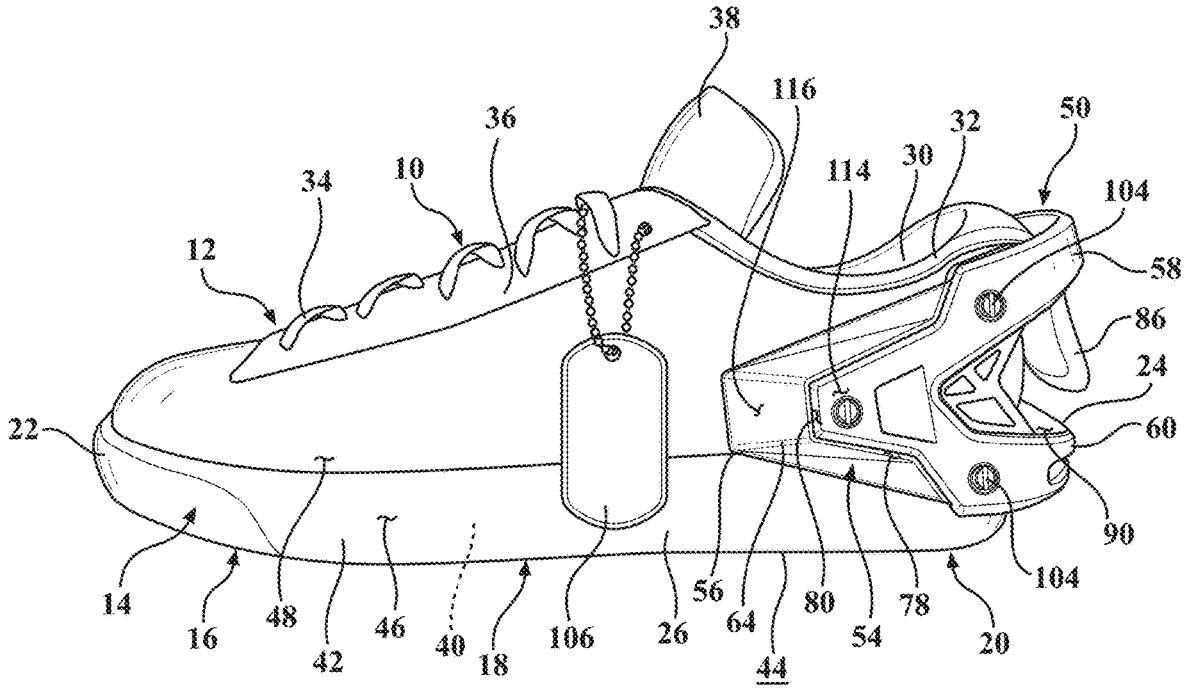
FIG. 2 is a medial side view of the article of footwear shown in FIG. 1.

Referring to FIGS. 1-5, a first aspect of an article of footwear 10 includes an upper 12 and a sole structure 14. The article of footwear 10 may be divided into one or more regions. The regions may include a forefoot region 16, a mid-foot region 18, and a heel region 20, as shown in FIG. 2. The forefoot region 16 may be subdivided into a toe portion corresponding with phalanges, and a ball portion associated with metatarsal bones of a foot. The mid-foot region 18 may correspond with an arch area of the foot, and the heel region 20 may correspond with rear portions of the foot, including a calcaneus bone.

The footwear 10 may further include an anterior end 22 associated with a forward-most point of the forefoot region 16, and a posterior end 24 corresponding to a rearward-most point of the heel region 20. A longitudinal axis of the footwear 10 extends along a length of the footwear 10 from the anterior end 22 to the posterior end 24, parallel to a ground surface. The longitudinal axis is centrally located along the length of the footwear 10, and generally divides the footwear 10 into a lateral side 26 and a medial side 28. Accordingly, the lateral side 26 and the medial side 28 respectively correspond with opposite sides of the footwear 10 and extend through the regions 16, 18, 20. As used herein, a longitudinal direction refers to the direction extending from the anterior end 22 to the posterior end 24, while a lateral direction refers to the direction transverse to the longitudinal direction and extending from the lateral side 26 and the medial side 28.

The upper 12 includes interior surfaces that define an interior void 30 configured to receive and secure a foot for support on the sole structure 14. The upper 12 may be formed from one or more materials that are stitched or adhesively bonded together to form the interior void 30. Suitable materials of the upper 12 may include, but are not limited to, mesh, textiles, foam, leather, and synthetic leather. The materials may be selected and located to impart properties of durability, air-permeability, wear-resistance, flexibility, and comfort.

The upper 12 may include a strobel (not shown) having a bottom surface opposing the sole structure 14 and an opposing top surface defining a footbed of the interior void 30. Stitching or adhesives may secure the strobel to the upper 12. A profile of the footbed is defined by the sole structure 14, and may be contoured to conform to a profile of the bottom surface (e.g., plantar) of the foot. Optionally, the upper 12 may also incorporate additional layers such as an insole or sockliner (not shown) that may be disposed upon the strobel and reside within the interior void 30 of the upper 12 to receive a plantar surface of the foot to enhance the comfort of the article of footwear 10.

Figure 3:
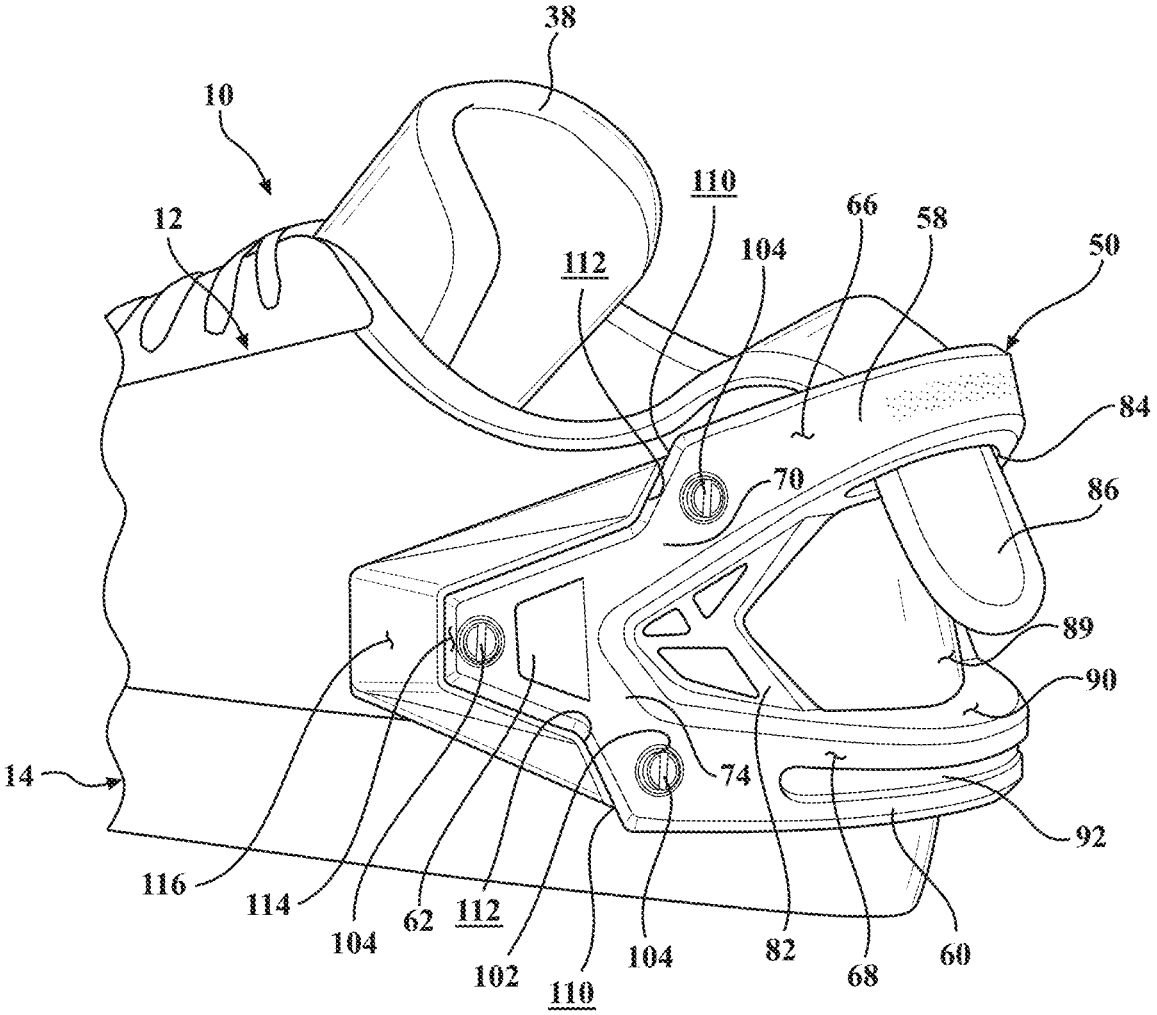
FIG. 3 is a partial rear perspective view of the article of footwear shown in FIG. 1.

Referring to FIGS. 1-3, an ankle opening 32 in the heel region 20 may provide access to the interior void 30. For example, the ankle opening 32 may receive a foot to secure the foot within the void 30 and facilitate entry and removal of the foot from and to the interior void 30. In some examples, one or more fasteners 34 extend along the upper 12 to adjust a fit of the interior void 30 around the foot and to accommodate entry and removal of the foot therefrom. The upper 12 may include apertures 36 such as eyelets and/or other engagement features such as fabric or mesh loops that receive the fasteners 34. The fasteners 34 may include laces, straps, cords, hook-and-loop, or any other suitable type of fastener. The upper 12 may include a tongue portion 38 that extends between the interior void 30 and the fasteners 34.

With reference to FIGS. 1-5, the sole structure 14 includes a midsole 40 and an outsole 42. Generally, the midsole 40 is configured to impart performance characteristics to the sole structure 14 such as cushioning, responsiveness, and energy distribution. The outsole 42 may be attached to or formed integrally with the midsole 40, and forms a ground-contacting surface 44 of the article of footwear 10. Accordingly, the outsole 42 is configured to impart characteristics related to traction and abrasion resistance.

The midsole 40 extends along a length of the article of footwear 10 from the anterior end 22 to the posterior end 24 and from the lateral side 26 to the medial side 28. The midsole may be formed of a resilient polymeric material, such as foam or rubber, to impart properties of cushioning, responsiveness, and energy distribution to the foot of the wearer. Example resilient polymeric materials for the midsole 40 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The midsole 40 may be attached to the strobel via a suitable adhesive such that a top surface of the midsole 40 is attached directly to the strobel via the adhesive. In this construction, the outsole 42 may be attached to a bottom surface of the midsole 40, which is disposed on an opposite side of the midsole 40 than the top surface. As with the top surface of the midsole 40, the bottom surface of the midsole 40 may be attached directly to the outsole 42 by using an adhesive. Finally, the outsole 42 may extend in a direction toward the upper 12 and be attached to sidewalls of the midsole 40 such that a material of the outsole 42—rather than a material of the midsole 40—forms an outer perimeter surface 46 of the sole structure 14. In this configuration, a material of the outsole 42 may extend sufficiently toward the upper 12 such that a material of the outsole 42 is attached directly to an exterior surface 48 of the upper 12. Allowing the outsole 42 to extend sufficiently toward the upper 12 such that the outsole 42 is in contact with the exterior surface 48 of the upper 12 allows the outsole 42 to form the exterior surface of the sole structure 14 both at the outer perimeter surface 46 and the ground-contacting surface 44. Because the outsole 42 may be formed from an abrasion-resistant material such as rubber, forming the outer perimeter surface 46 and the ground-contacting surface 44 from rubber provides the sole structure 14 and, thus, the article of footwear 10, with protection during use.

Figure 4:
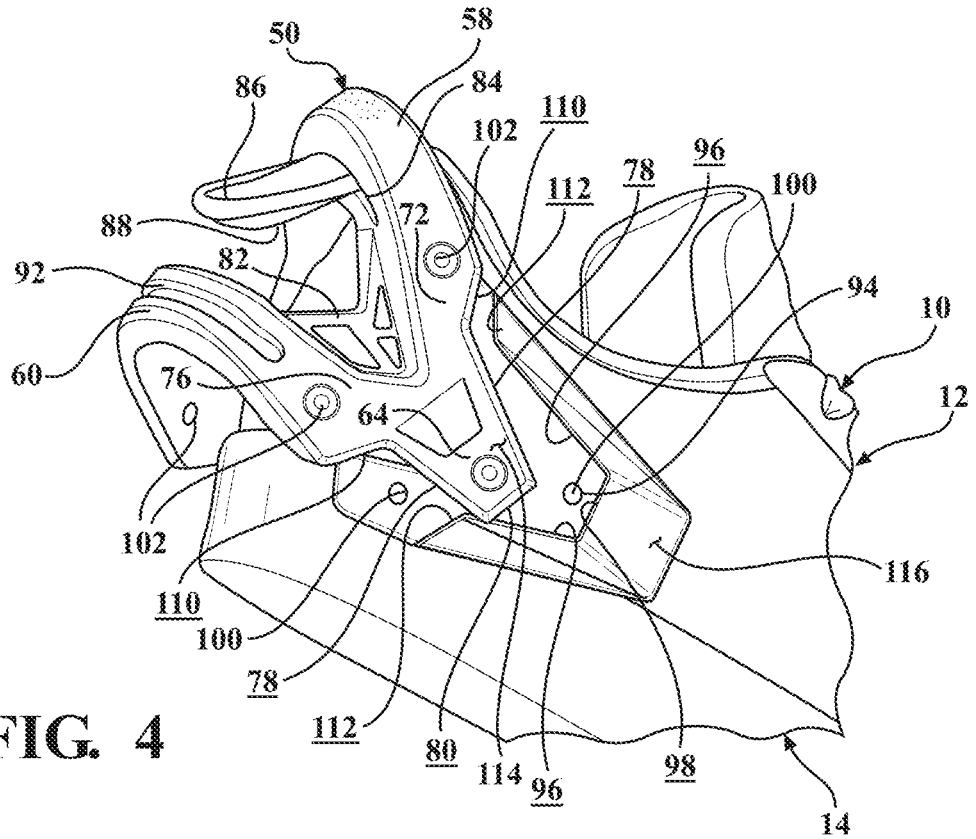
FIG. 4 is a partial exploded view of the article of footwear shown in FIG. 1.
Figure 5:
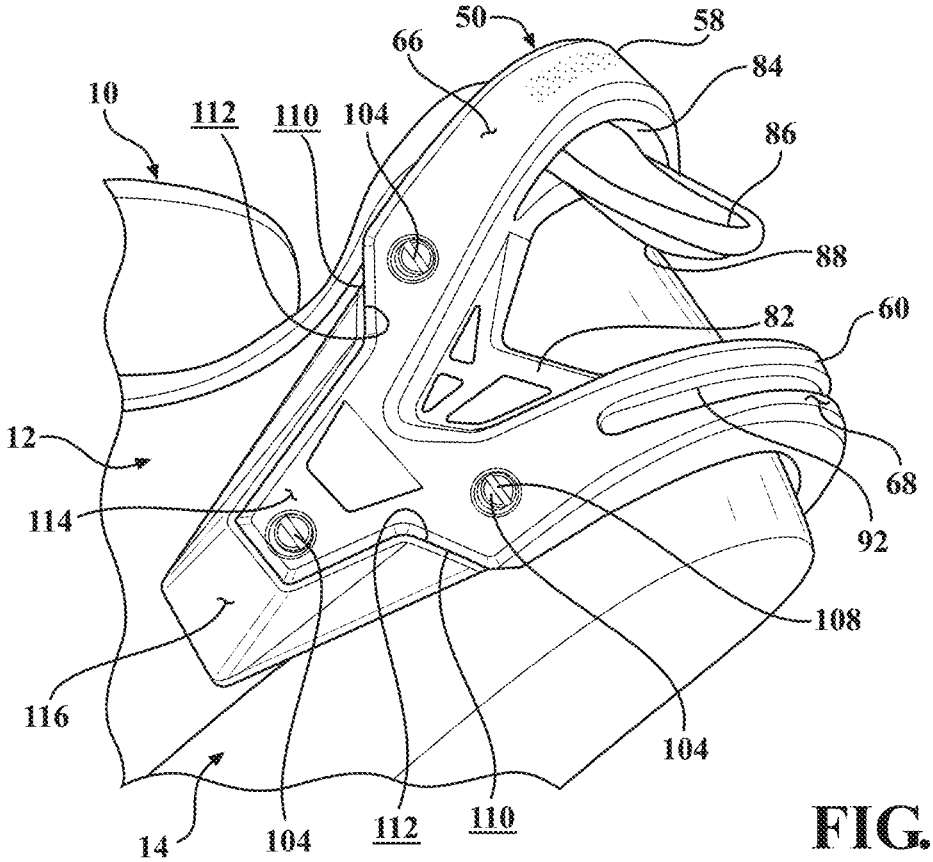
FIG. 5 is a partial bottom perspective view of the article of footwear shown in FIG. 1.
Figure 6:
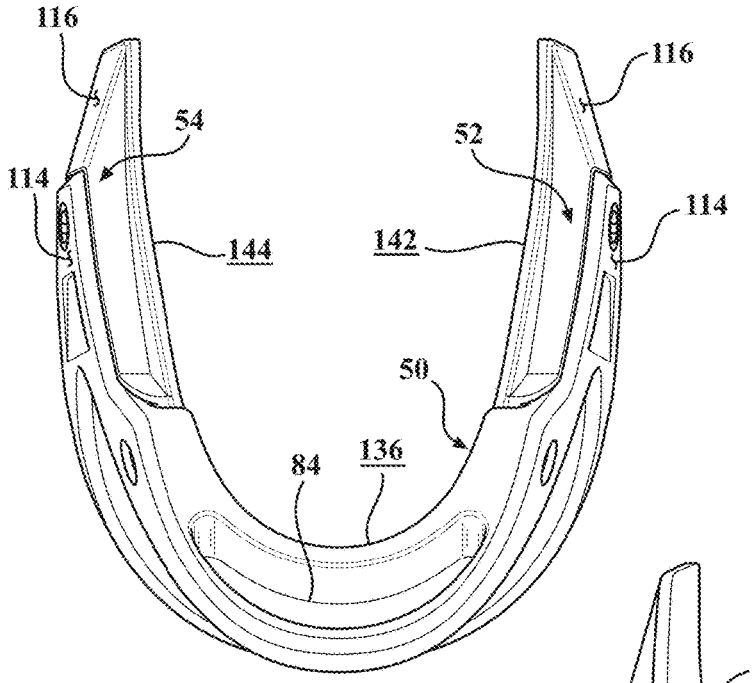
FIG. 6 is a top plan view of a clip of the article of footwear of FIG. 1.
Figure 7:
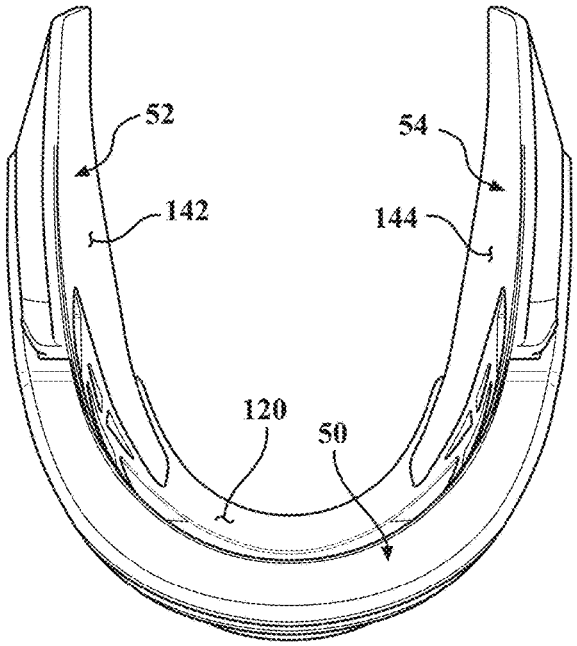
FIG. 7 is a bottom plan view of the clip of FIG. 6.
Figure 8:
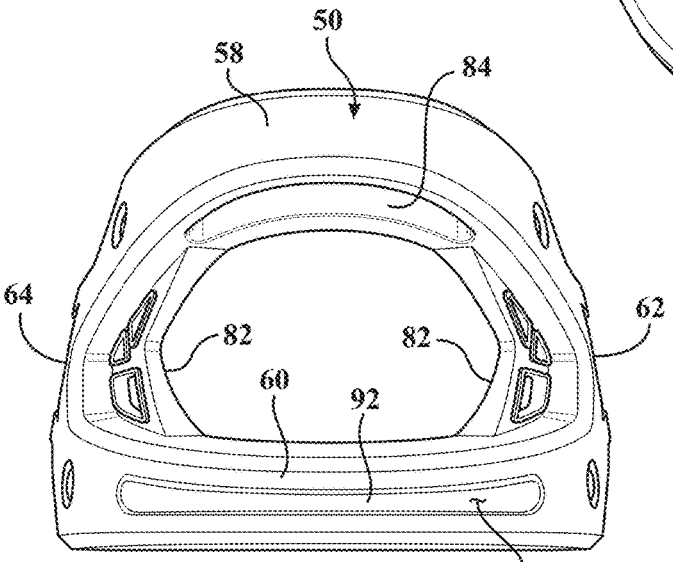
FIG. 8 is a rear elevation view of the clip of FIG. 6.
Figure 9:
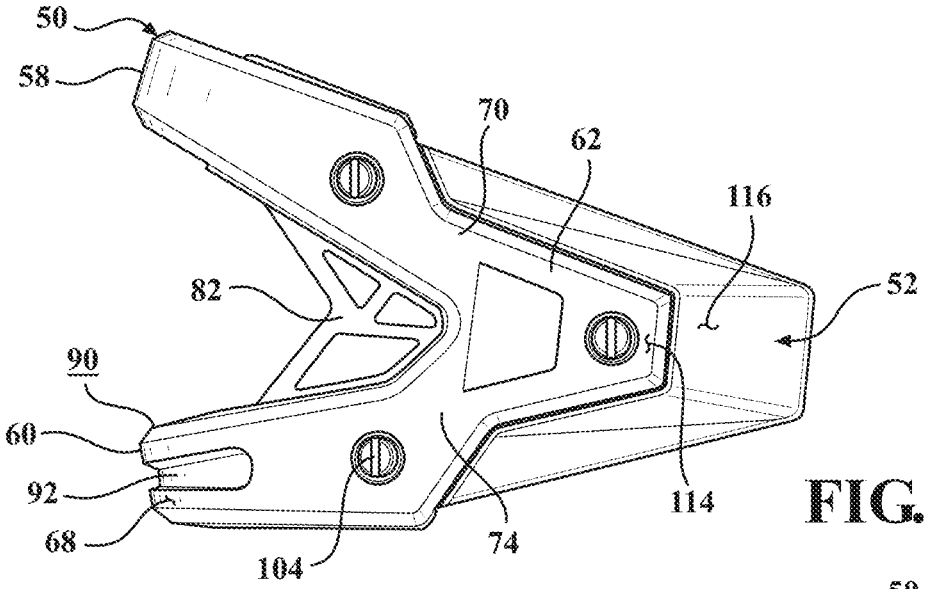
FIG. 9 is a medial side view of the clip of FIG. 6.
Figure 10:
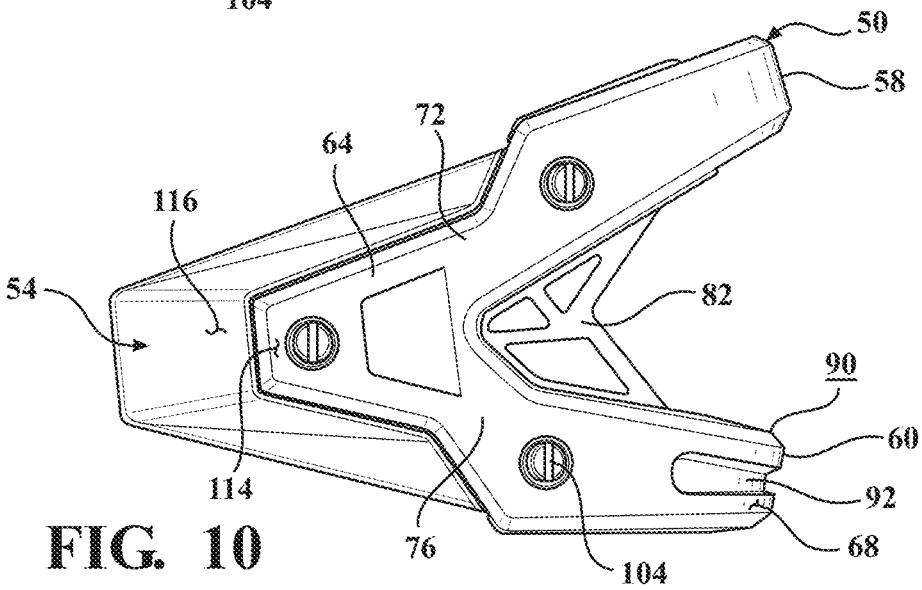
FIG. 10 is a lateral side view of the clip of FIG. 6.

With particular reference to FIGS. 3-5, the sole structure is shown as including a clip 50 that is attached to the article of footwear 10 at the heel region 20. As shown, the clip 50 is attached to the article of footwear 10 via a medial receiver 52 and a lateral receiver 54. In one configuration, the medial receiver 52 and the lateral receiver 54 are attached to the outer perimeter surface 46 of the sole structure 14 and to the exterior surface 48 of the upper 12. In so doing, the medial receiver 52 and the lateral receiver 54 span a junction 56 of the upper 12 and the sole structure 14 (FIGS. 1 and 2). As will be described in detail below, the clip 50, the medial receiver 52, and the lateral receiver 54 are formed from one or more relatively rigid materials to provide the clip 50, the medial receiver 52, and the lateral receiver 54 with a higher rigidity than a material forming the upper 12. In so doing, the clip 50, the medial receiver 52, and the lateral receiver 54 cooperate to reinforce the heel region 20 of the upper 12 at both the lateral side 26 and the medial side 28 as well as along the posterior end 24.

With particular reference to FIGS. 3 and 4, the clip 50 is shown as including an upper brace 58, a lower brace 60, a medial junction 62, and a lateral junction 64. The upper brace 58, the lower brace 60, the medial junction 62, and the lateral junction 64 are integrally formed with one another and may be formed from a thermoset or thermoplastic polymer material. For example, the clip 50 may be injection-molded from polyether block amide (PEBAX®) or any suitable polymer material that provides the clip 50 with a degree of rigidity and strength relative to the material of the upper 12.

The upper brace 58 extends from the lateral side 26 to the medial side 28 and includes an arcuate shape having an outer, arcuate surface 66. Similarly, the lower brace 60 includes an arcuate shape having an outer, arcuate surface 68 and likewise extends from the lateral side 26 to the medial side 28. The upper brace 58 and the lower brace 60 may each include a thickness that is variable along the length of each brace 58, 60. For example, the upper and/or lower brace 58, 60 may include a thickness that tapers from a posterior-most point of each brace 58, 60 toward the medial junction 62 and/or the lateral junction 64.

The upper brace 58 includes a first end 70 that terminates at the medial junction 62 and a second end 72 that terminates at the lateral junction 64. Similarly, the lower brace 60 includes a first end 74 that terminates at the medial junction 62 and a second end 76 that terminates at the lateral junction 64. The medial junction 62 and the lateral junction 64 each include a pair of convergent, tapered surfaces 78 that terminate at a distal end having a substantially planar surface 80.

One or more reinforcement ribs 82 extend between and connect the upper brace 58 and the lower brace 60. The reinforcement ribs 82 are positioned in such a way to help strengthen the junction between the upper brace 58 and the lower brace 60 to restrict movement of the upper brace 58 toward the lower brace 60. In so doing, the reinforcement ribs 82 help ensure that the braces 58, 60 can sufficiently maintain the heel region 20 in an upright position to facilitate insertion of a foot into the interior void 30.

The reinforcement ribs 82 are angled such that the posterior-most ribs 82 extend in a direction toward the forefoot region 16 and cooperate to form a substantially V-shaped pattern, as shown in FIG. 4. The ribs 82 are spaced apart from one another to create openings between adjacent ribs 82. In so doing, the ribs 82 provide the clip 50 with a desired aesthetic appearance that allows a material of the upper 12 beneath the clip 50 to be visible at the lateral side 26 and the medial side 28 while concurrently reducing the overall weight of the clip 50 and, thus, the overall weight of the article of footwear 10.

The upper brace 58 additionally includes a slot 84 extending through a thickness of the upper brace 58. The slot 84 extends along the upper brace 58 and includes an arcuate shape that tapers from a posterior-most point of the upper brace 58 toward the medial junction 62 and the lateral junction 64. As such, a width of the slot 84 decreases in size from the posterior-most point of the upper brace 58 toward the medial junction 62 and the lateral junction 64. In one configuration, a portion of the upper 12 is received by and extends through the slot 84. For example, a tab 86 may extend from the ankle opening 32 in a direction toward the posterior end 24 and through the slot 84. The tab 86 may include a fastener 88 such as a snap or hook-and-loop fastener that is received by a mating fastener 89 disposed on the exterior surface 48 of the upper 12. This way, the tab 86 can be selectively inserted through the slot 84 and attached to the upper 12 such that a portion of the upper brace 58 is disposed between the tab 86 and the upper 12 when the fasteners 88, 89 are engaged with one another.

As described above, the lower brace 60 is spaced apart from the upper brace 58. As such, a material of the upper 12 in the heel region 20 is exposed in an area between the upper brace 58 and the lower brace 60. When the tab 86 extends through the slot 84 and is attached to the fastener 88, the tab 86 is likewise visible in the area between the upper brace 58 and the lower brace 60. Spacing the braces 58, 60 apart from one another not only allows for the upper 12 and the tab 86 to be exposed between the braces 58, 60 but, also, provides access to an area between the braces 58, 60 and to a top surface 90 of the lower brace 60. Providing access to the top surface 90 of the lower brace 60 allows the top surface 90 to act as a doffing ledge to facilitate removal of a foot from the interior void 30. Specifically, a user can apply a force on the surface 90 of the lower brace 60 by placing a foot or hand on the surface 90 while simultaneously removing a foot from the interior void 30. The lower brace 60 could additionally include a groove 92 to provide yet another structure that a wearer can use as a doffing ledge and, further, to reduce the overall weight of the clip 50.

The clip 50 is attached to the article of footwear 10 by engaging the medial junction 62 and the lateral junction 64 of the clip 50 with the medial receiver 52 and the lateral receiver 54, respectively. Optionally, each of the medial receiver 52 and the lateral receiver 54 includes a recess 94 (FIG. 4) having the shape of the medial junction 62 and the lateral junction 64. When present, the recess 94 includes a pair of tapered surfaces 96 that converge with one another and terminate at a substantially planar surface 98. When the clip 50 is installed in the receivers 52, 54, the tapered surfaces 78 of the junctions 62, 64 oppose the tapered surfaces 96 of the receivers 52, 54 and the planar surfaces 80 oppose the planar surfaces 98 of the respective receivers 52, 54. Accordingly, when the junctions 62, 64 are sufficiently inserted into the receivers 52, 54, the tapered surfaces 78 of the clip 50 are in contact with the tapered surfaces 96 of the receivers 52, 54 and the planar surfaces 80 of the clip 50 are in contact with the respective planar surfaces 98 of the receivers 52, 54.

The medial receiver 52 is attached to the upper 12 and to the sole structure 14 at the medial side 28 and the lateral receiver 54 is attached to the upper 12 and to the sole structure 14 at the lateral side 26. In one configuration, the receivers 52, 54 span a junction of the upper 12 and the sole structure 14 and are attached to the upper 12 and the sole structure 14 using a suitable adhesive. Further, these elements 52, 54 may be formed from the same or different material as a material forming the clip 50 and may include the same or different rigidity than a material forming the clip 50.

The medial receiver 52 and the lateral receiver 54 each include a plurality of threaded bores 100. The threaded bores 100 may be separately formed from the receivers 52, 54 and may be formed from a different material than a material forming the receivers 52, 54. For example, the threaded bores 100 may be formed from metal and may be attached to apertures of the receivers 52, 54. For example, the threaded bores 100 may be metal collars that include internal threads. The metal collars may be inserted into apertures formed in the receivers 52, 54 and may be retained by a suitable adhesive and/or external threads (not shown) that engage the polymer material of the receivers 52, 54. In the illustrated example, the threaded bores 100 are attached to retainers or flanges 101 (FIG. 11) that are embedded within the receivers 52, 54. Regardless of the particular construction of the threaded bores 100, the bores 100 provide a fastener for attaching the clip 50 to the receivers 52, 54 and, thus, to the article of footwear 10, as will be described in detail below.

As shown in FIG. 4, each clip 50 includes a series of apertures 102 formed therethrough. In the example shown, each of the upper brace 58, the lower brace 60, and the junctions 62, 64 includes at least one aperture 102 with the braces 58, 60 each including a pair of apertures; one near the medial junction 62 and one near the lateral junction 64. The apertures 102 of the example shown in the figures include six (6) total apertures that are axially aligned with the bores 100 of the receivers 52, 54. Accordingly, when the clip 50 is positioned relative to the receivers 52, 54, the apertures 102 of the clip 50 are aligned with the threaded bores 100 of the receivers 52, 54 and a threaded fastener 104 can be inserted through the apertures 102 and threadably engage the bores 100 of the receivers 52, 54.

The clip 50 may be selectively removed from the article of footwear 10 by removing the fasteners 104 and removing the tab 86 from the slot 84. Once the fasteners 104 and tab 86 are removed from the clip 50, the clip 50 may be removed from the footwear 10. The article of footwear 10 may include a tool 106 (FIG. 2) in the form of a dog tag that adds to the aesthetics of the footwear 10 while concurrently providing a way to rotate the fasteners 104 relative to the clip 50. Namely, an edge of the tool 106 may be used to engage a slot 108 (FIG. 5) of the fasteners 104 to allow the tool 106 to rotate the fasteners 104 relative to the clip 50.

The clip 50 may be reinstalled on the article of footwear 10 by inserting the medial junction 62 and the lateral junction 64 into the respective recesses 94 of the receivers 52, 54. The clip 50 is inserted into the recesses 94 until the planar surface 80 of each junction 62, 64 engages the planar surface 98 of each receiver 52, 54. Further, while the surfaces 80, 98 may engage one another to properly position the clip 50 relative to the receivers 52, 54, angled surfaces 110 of the upper brace 58 and the lower brace 60 may respectively engage outer, angled surfaces 112 of the receivers 52, 54 to position the clip 50 relative to and within the receivers 52, 54. Once the clip 50 is in position, the fasteners 104 can be inserted into the threaded bores 100 via the apertures 102 to maintain the position of the clip 50 relative to the receivers 52, 54.

When the clip 50 is installed in the receivers 52, 54, an outer surface 114 of each junction 62, 64 cooperates with a tapered, outer surface 116 of each receiver 52, 54 to provide the article of footwear 10 with a generally smooth surface that transitions gradually into the exterior surface 48 of the upper 12. As shown in the figures, the outer surfaces 116 of the receivers 52, 54 taper in a direction toward the forefoot region 16 and in a direction toward the sole structure 14 and the ankle opening 32.

Figure 11:
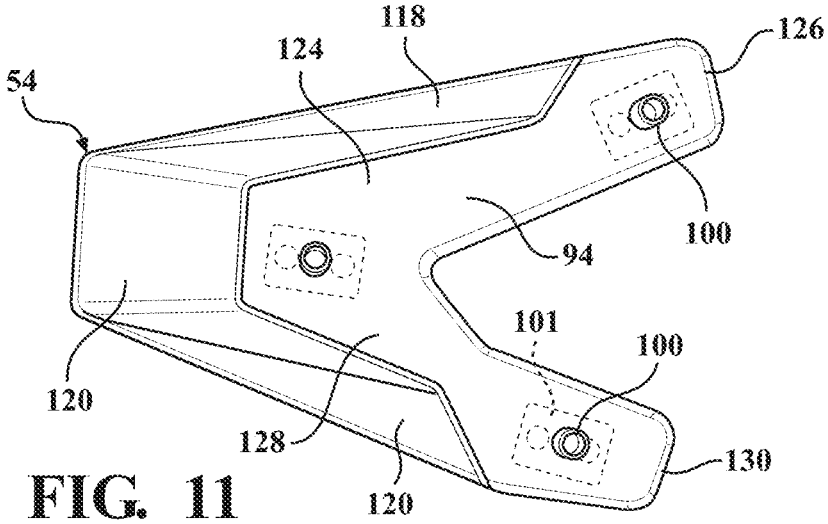
FIG. 11 is a lateral side view of a lateral receiver of the clip of FIG. 6.
Figure 12:
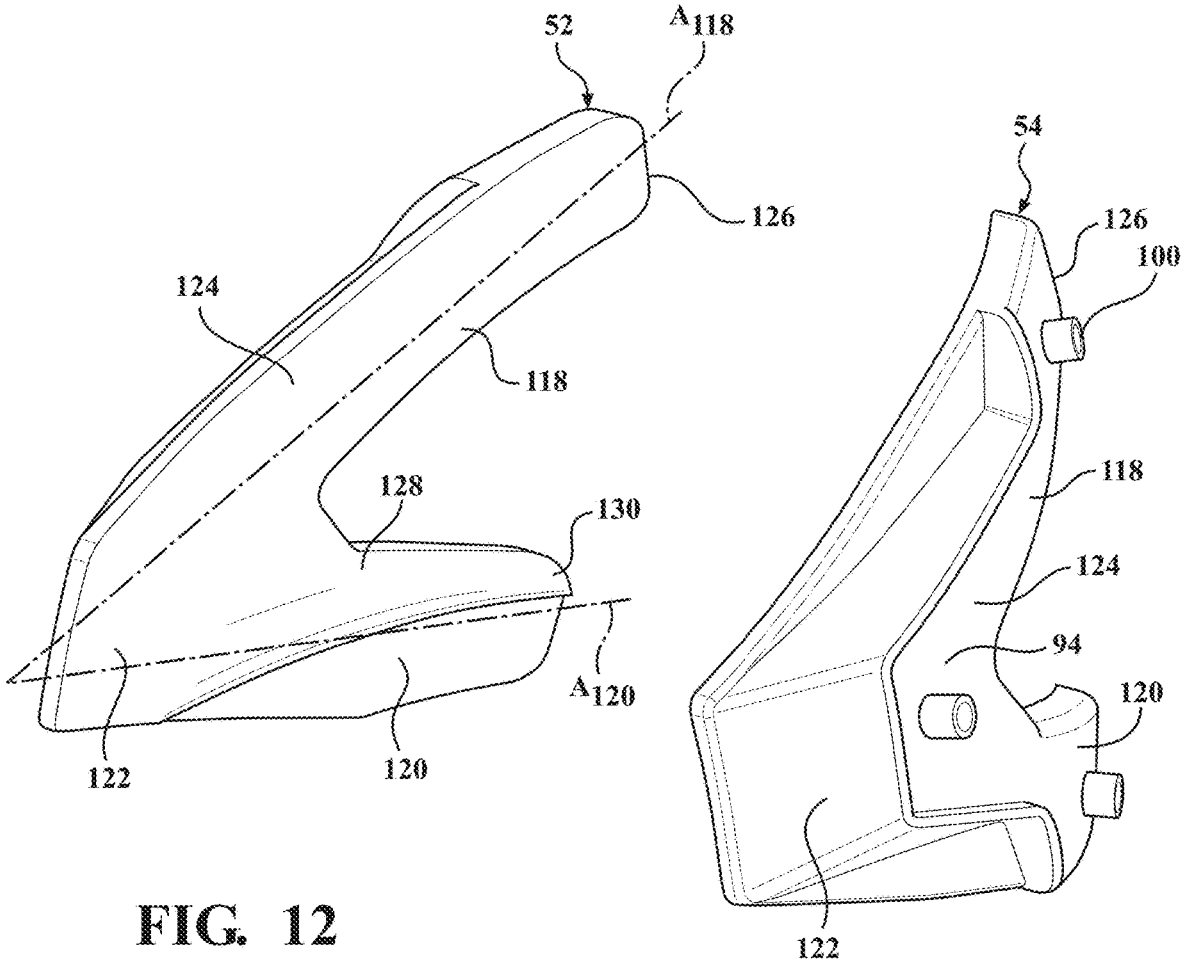
FIG. 12 is a perspective view of a lateral receiver and a medial receiver of the clip of FIG. 6.

With reference to FIGS. 11 and 12, the receivers 52, 54 are illustrated in a disassembled state from the clip 50. Each receiver 52, 54 includes an upper arm 118 and a lower arm 120 that are connected to each other at a respective receiver junction 122. In each case, the upper arm 118 extends along a longitudinal axis $A_{118}$ from a proximal end 124 at the junction 122 to a distal end 126 at the opposite end from the junction 122. Likewise, the lower arm 120 extends along a longitudinal axis $A_{120}$ from a proximal end 128 at the junction 122 to a distal end 130 at an opposite end from the junction 122. The longitudinal axis $A_{118}$ of the upper arm 118 diverges from the longitudinal axis $A_{120}$ of the lower arm 120 along a direction from the proximal end 124 to the distal end 126. Optionally, the receivers 52, 54 may include the flanges 101 that are attached to or embedded within the receiver and define the threaded bores 100. Thus, the threaded bores 100 may be configured to extend through the apertures 102 formed through the clip 50, whereby the fasteners 104 secure the receivers 52, 54 to the clip 50.

In addition or as an alternative to the interface between the clip 50 and the recesses 94 of the receivers 52, 54, the clip 50 may include one or more engagement features for aligning and securing a relative position of the receivers 52, 54 and the clip 50. For example, with reference to FIG. 13, the clip 50 includes an inner surface 136 that is configured to face the upper 12 when the clip 50 is assembled to the footwear 10. The inner surface 136 defines a medial socket 138 disposed on the medial side 28 and a lateral socket 140 disposed on the lateral side 26. Generally, the medial socket 138 is configured to at least partially receive the medial receiver 52 and the lateral socket 140 is configured to at least partially receive the lateral receiver 54 such that when the receivers 52, 54 are assembled with the clip 50, respective inner surfaces 142, 144 of the receivers 52, 52 are flush with the inner surface 136 of the clip 50.

Figure 13:
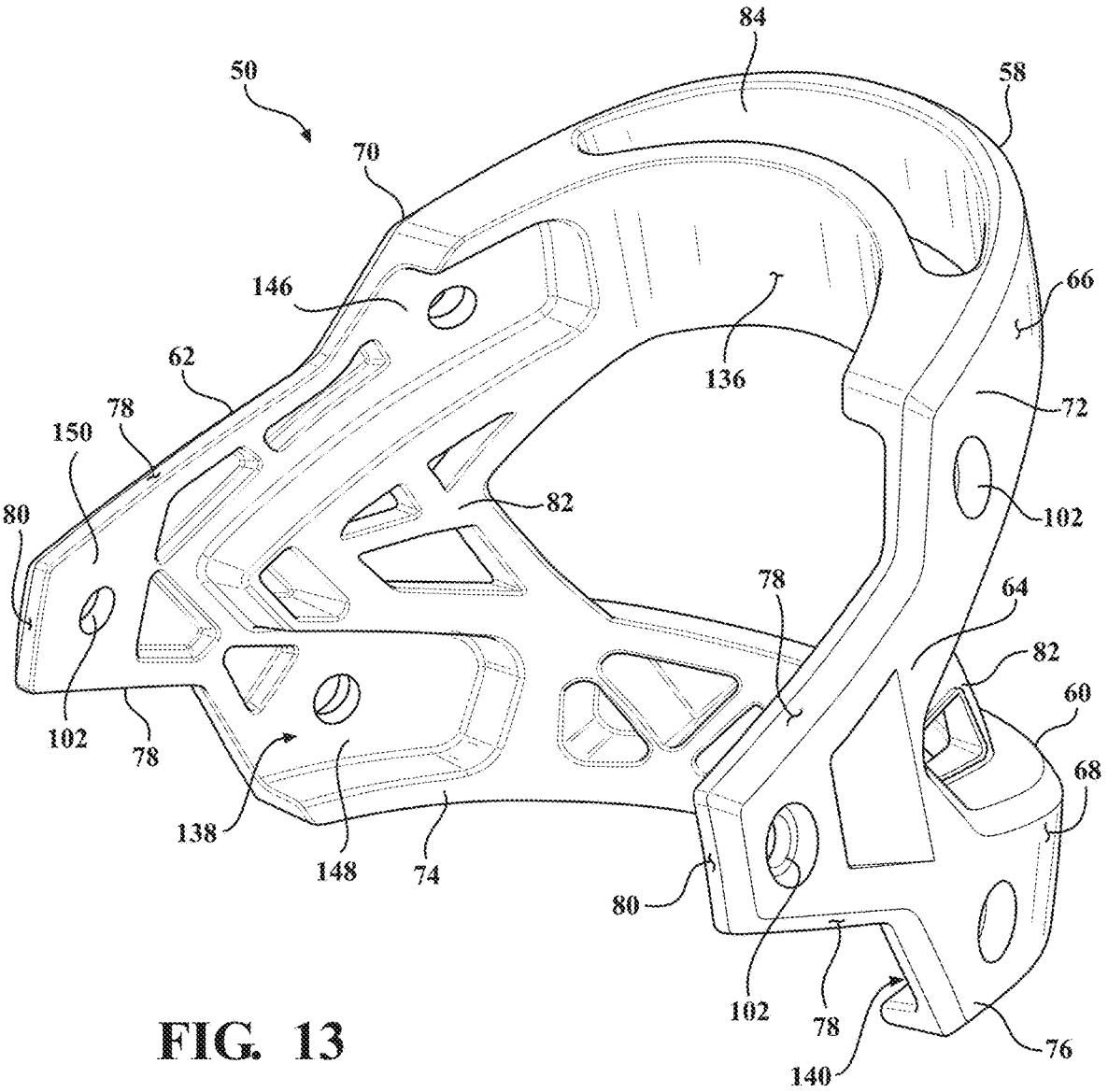
FIG. 13 is a front perspective view of the clip of FIG. 6 with the medial receiver and the lateral receiver omitted for clarity.

With continued reference to FIG. 13, the medial socket 138 is shown and has a profile that corresponds to a profile of the medial receiver 52. For example, the medial socket 138 defines an upper arm portion 146, a lower arm portion 148, and a junction portion 150 each configured to receive the corresponding elements 118, 120, 122 of the medial receiver 52 described previously. Thus, when assembled with the clip 50, the medial receiver 52 is received within the socket 138 to provide a continuous and flush surface along the interior of the clip 50. While the medial socket 138 is shown and described here, it should be appreciated that the lateral socket 124 has a substantially similar configuration formed along the opposite lateral side of the clip 50 and is configured to interface with the lateral receiver 54 in a similar fashion.

Figure 14:
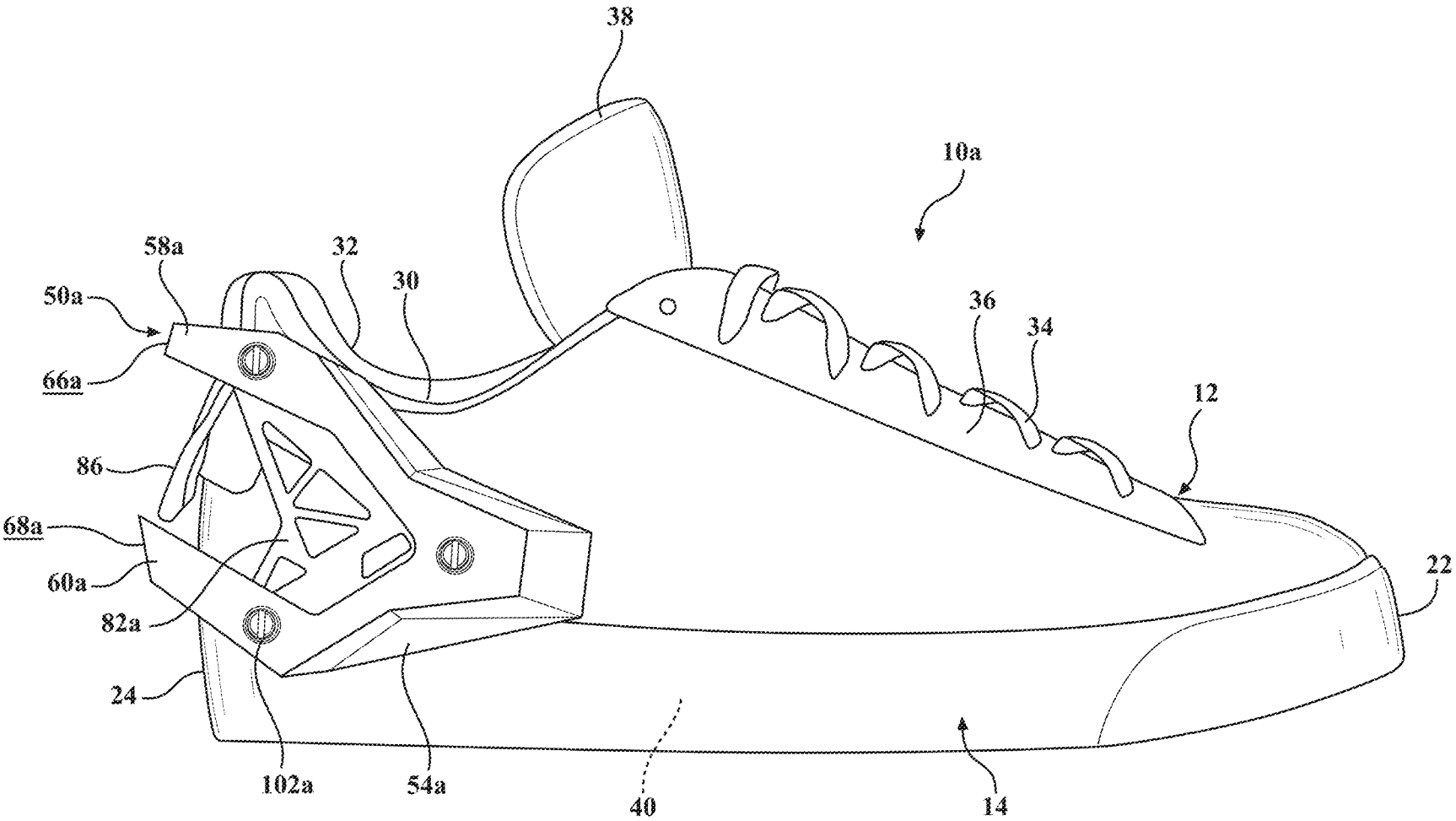
FIG. 14 is lateral side view of an article of footwear in accordance with principles of the present disclosure.
Figure 15:
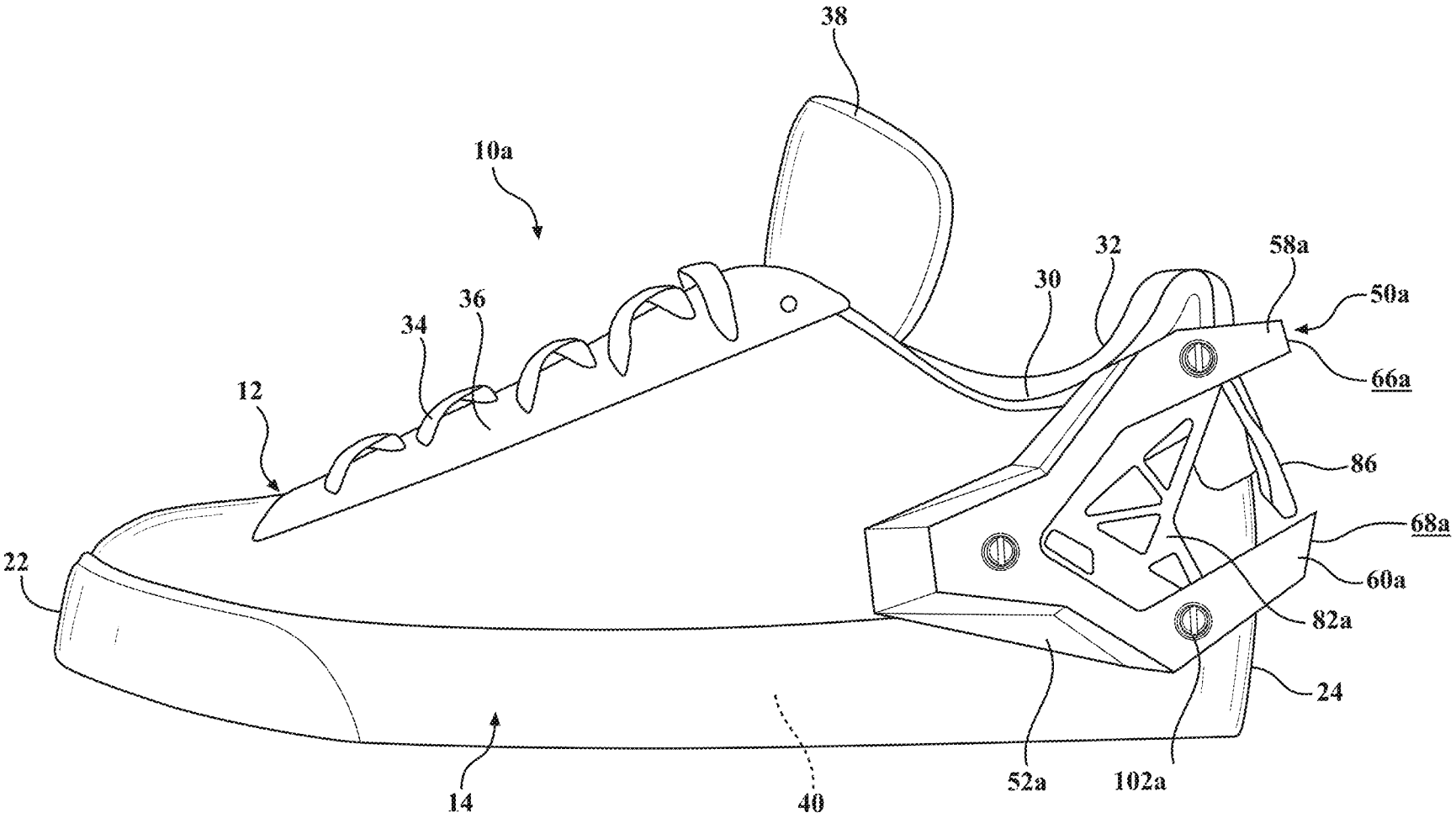
FIG. 15 is lateral side view of an article of footwear in accordance with principles of the present disclosure.

With reference to FIGS. 14-15, an article of footwear 10*a* is provided. The article of footwear 10*a* is identical to the article of footwear 10 with the exception of the clip 50*a* and the receivers 52*a*, 54*a*. Like reference numbers will be used hereinafter and in the drawings to identify like components while like reference numbers containing letter extensions will be used to identify those components that have been modified.

The clip 50*a* includes an upper brace 58*a* and a lower brace 60*a*. The braces 58*a*, 60*a* are similar to the braces 58, 60 of the clip 50 but include a different shape and configuration. For example, the outer arcuate surfaces 66*a*, 68*a* have a different shape as compared to the outer arcuate surfaces 66, 68. Further, the braces 58*a*, 60*a* are positioned at different angles relative to the braces 58, 60. See, for example, the lower brace 60*a* being angled upward and away from the sole structure 14 while the lower brace 60 of the clip 50 is substantially aligned with the sole structure 14.

In addition to the foregoing, the pattern of the apertures 102*a* is different than that of the clip 50 due to the shape and configuration of the medial and lateral receivers 52*a*, 54*a*. As shown in FIG. 14, the lateral receiver 54*a* is larger than the lateral receiver 54 and extends further toward the posterior end 24 of the article of footwear 10*a* than the lateral receiver 54. As shown in FIG. 15, the medial receiver 52*a* is the mirror opposite of the lateral receiver 54*a* to allow the medial receiver 52*a* to be properly positioned on the medial side 28 and receive the clip 50*a*. Finally, the reinforcement ribs 82*a* include a different shape and configuration as compared to the reinforcement ribs 82 due largely to the change in angular position between the upper brace 58*a* and the lower brace 60*a*.

The following Clauses provide an exemplary configuration for an article of footwear described above.

Clause 1. An article of footwear comprising an upper, a sole structure attached to the upper and defining a ground-contacting surface, a first receiver disposed on one of a medial side of the upper and a lateral side of the upper and extending over a junction between the upper and the sole structure, and a clip attached to the first receiver and extending around a heel region of the upper.

Clause 2. The article of footwear of Clause 1, wherein the first receiver includes a first recess.

Clause 3. The article of footwear of Clause 2, wherein the clip includes a first brace disposed adjacent to an ankle opening of the upper and a second brace spaced apart from the first brace and disposed adjacent to the sole structure, the first brace and the second brace joined to one another at a first junction that is received by the first recess of the first receiver.

Clause 4. The article of footwear of Clause 3, wherein the first recess includes a shape that conforms to a shape of the first junction.

Clause 5. The article of footwear of Clause 3 or Clause 4, further comprising a second receiver disposed on the other of the medial side and the lateral side and extending over the junction between the upper and the sole structure, the second receiver including a second recess that receives a second junction where the first brace and the second brace are joined to one another.

Clause 6. The article of footwear of any of the preceding Clauses, wherein the clip is attached to the first receiver by at least one threaded fastener.

Clause 7. The article of footwear of Clause 6, wherein the first receiver includes at least one threaded bore that receives the threaded fastener.

Clause 8. The article of footwear of any of the preceding Clauses, wherein the clip includes an aperture proximate to an ankle opening of the upper.

Clause 9. The article of footwear of Clause 8, further comprising a tab attached to the ankle opening and received through the aperture of the clip.

Clause 10. The article of footwear of Clause 1, wherein the clip includes a socket configured to receive the first receiver.

Clause 11. An article of footwear comprising an upper, a sole structure attached to the upper and defining a ground-contacting surface, a first receiver disposed on one of a medial side of the upper and a lateral side of the upper, a second receiver disposed on the other of the medial side of the upper and the lateral side of the upper and a clip attached to the first receiver and the second receiver and including a first brace extending proximate to an ankle opening of the upper and a second brace extending proximate to the sole structure, the first brace spaced apart and separated from the second brace and including an aperture through which a portion of the upper extends.

Clause 12. The article of footwear of Clause 11, wherein the clip extends around a heel region of the upper.

Clause 13. The article of footwear of any of the preceding Clauses, wherein the aperture is an elongate slot that extends along a length of the first brace.

Clause 14. The article of footwear of Clause 13, wherein the portion of the upper that extends through the elongate slot is a tab that extends from an ankle opening of the upper.

Clause 15. The article of footwear of Clause 14, wherein the tab includes a first fastener and the upper includes a second fastener, the first fastener selectively engaging the second fastener between the first brace and the second brace when the tab extends through the elongate slot.

Clause 16. The article of footwear of any of the preceding Clauses, wherein the clip is attached to the first receiver by a first threaded fastener and is attached to the second receiver by a second threaded fastener.

Clause 17. The article of footwear of any of the preceding Clauses, wherein the clip is formed from a material that is more rigid than a material forming the upper.

Clause 18. The article of footwear of any of the preceding Clauses, wherein the upper is exposed between the first brace and the second brace.

Clause 19. The article of footwear of any of the preceding Clauses, further comprising at least one reinforcement rib extending between and connecting the first brace and the second brace.

Clause 20. The article of footwear of any of the preceding Clauses, wherein at least one of the first brace and the second brace includes a thickness that tapers in a direction toward the first receiver and the second receiver.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper;

a sole structure attached to the upper and defining a ground-contacting surface;

a first receiver that begins and terminates on one of a medial side of the upper and a lateral side of the upper and extends over a junction between the upper and the sole structure, the first receiver including a first recess;

a clip attached to the first receiver and extending around a heel region of the upper, the clip including a first brace disposed adjacent to an ankle opening of the upper and a second brace spaced apart from the first brace and disposed adjacent to the sole structure, the first brace and the second brace joined to one another at a first junction that is received by the first recess of the first receiver; and a second receiver that begins and terminates on the other of the medial side and the lateral side and extends over the junction between the upper and the sole structure, the second receiver including a second recess that receives a second junction where the first brace and the second brace are joined to one another.

2. The article of footwear of claim 1, wherein the first recess includes a shape that conforms to a shape of the first junction.

3. The article of footwear of claim 1, wherein the clip is attached to the first receiver by at least one threaded fastener.

4. The article of footwear of claim 3, wherein the first receiver includes at least one threaded bore that receives the threaded fastener.

5. The article of footwear of claim 1, wherein the clip includes an aperture proximate to an ankle opening of the upper.

6. The article of footwear of claim 5, further comprising a tab attached to the ankle opening and received through the aperture of the clip.

7. The article of footwear of claim 1, wherein the clip includes a socket configured to receive the first receiver.

8. An article of footwear comprising:

an upper;

a sole structure attached to the upper and defining a ground-contacting surface;

a first receiver that begins and terminates on one of a medial side of the upper and a lateral side of the upper;

a second receiver that begins and terminates on the other of the medial side of the upper and the lateral side of the upper; and a clip attached to the first receiver and the second receiver and including a first brace extending proximate to an ankle opening of the upper and a second brace extending proximate to the sole structure, the first brace spaced apart and separated from the second brace and the first brace including an aperture through which a portion of the upper extends.

9. The article of footwear of claim 8, wherein the clip extends around a heel region of the upper.

10. The article of footwear of claim 8, wherein the aperture is an elongate slot that extends along a length of the first brace.

11. The article of footwear of claim 10, wherein the portion of the upper that extends through the elongate slot is a tab that extends from an ankle opening of the upper.

12. The article of footwear of claim 11, wherein the tab includes a first fastener and the upper includes a second fastener, the first fastener selectively engaging the second fastener between the first brace and the second brace when the tab extends through the elongate slot.

13. The article of footwear of claim 8, wherein the clip is attached to the first receiver by a first threaded fastener and is attached to the second receiver by a second threaded fastener.

14. The article of footwear of claim 8, wherein the clip is formed from a material that is more rigid than a material forming the upper.

15. The article of footwear of claim 8, wherein the upper is exposed between the first brace and the second brace.

16. The article of footwear of claim 8, further comprising at least one reinforcement rib extending between and connecting the first brace and the second brace.

17. The article of footwear of claim 8, wherein at least one of the first brace and the second brace includes a thickness that tapers in a direction toward the first receiver and the second receiver.

18. An article of footwear comprising:

an upper;

a sole structure attached to the upper and defining a ground-contacting surface;

a first receiver disposed on one of a medial side of the upper and a lateral side of the upper;

a second receiver disposed on the other of the medial side of the upper and the lateral side of the upper; and a clip attached to the first receiver and the second receiver and including a first brace extending proximate to an ankle opening of the upper and a second brace extending proximate to the sole structure, the first brace spaced apart and separated from the second brace and the first brace including an aperture through which a portion of the upper extends;

wherein the aperture is an elongate slot that extends along a length of the first brace;

wherein the portion of the upper that extends through the elongate slot is a tab that extends from an ankle opening of the upper; and wherein the tab includes a first fastener and the upper includes a second fastener, the first fastener selectively engaging the second fastener between the first brace and the second brace when the tab extends through the elongate slot.

* * * * *